United States Patent [19]

Gill et al.

[11] Patent Number: 4,457,791

[45] Date of Patent: Jul. 3, 1984

[54] NEW PLASTICIZER FOR NITROPOLYMERS

[75] Inventors: Robert C. Gill, White Plains; George W. Nauflett, Fort Washington, both of Md.

[73] Assignee: The United States of America as represented by the Secretary of the Navy, Washington, D.C.

[21] Appl. No.: 391,901

[22] Filed: Jun. 25, 1982

[51] Int. Cl.[3] ..... C06B 45/10

[52] U.S. Cl. ..... 149/19.3; 149/19.1; 149/19.8; 149/92

[58] Field of Search ..... 149/92, 19.8, 19.1, 149/19.3

[56] References Cited

U.S. PATENT DOCUMENTS

| | | | |
|---|---|---|---|
| 2,485,855 | 10/1949 | Blomquist et al. | 149/92 |
| 4,033,798 | 7/1977 | Brodman et al. | 149/19.8 |
| 4,085,123 | 4/1978 | Flanagan et al. | 149/19.8 |
| 4,216,039 | 8/1980 | Pierce | 149/19.8 |
| 4,288,262 | 9/1981 | Flanagan et al. | 149/19.8 |
| 4,381,958 | 5/1983 | Howard | 149/19.8 |

OTHER PUBLICATIONS

Goodman, *J. Am. Chem. Soc.* 75, 3019-3020 (1953).

*Primary Examiner*—Edward A. Miller

*Attorney, Agent, or Firm*—R. F. Beers; K. E. Walden; J. C. LaPrade

[57] ABSTRACT

A novel composition of matter comprising a mixture of a nitrocellulose polymer and a plasticizer comprising N,N′ dimethyl methylene dinitramine.

8 Claims, No Drawings

NEW PLASTICIZER FOR NITROPOLYMERS

BACKGROUND OF THE INVENTION

It is necessary and required in the explosive art and in the propellant art to provide a plasticizer for nitrocellulose.

Nitramine plasticizers have been known for many years. However, all previously used nitramine plasticizers contained both nitramine and nitroxy ester groups $$(R-\overset{NO_2}{\overset{|}{N}}CH_2CH_2ONO_2).$$

N,N' Dimethyl methylenedinitroamine (DMMD) also known as N,N' dimethyl N-N dinitro-methanediamine. The abbreviation DMMD shall be used hereinafter to designate this compound is the first nitramine plasticizer which does not contain a nitroxy ester group. DMMD has the following formula:

$$CH_3-\overset{NO_2}{\overset{|}{N}}-CH_2-\overset{NO_2}{\overset{|}{N}}-CH_3$$

Although there are many well known and readily available plasticizers for nitropolymers, none are entirely satisfactory. Compounds such as adiponitrile, triacetin, dibutyl phthalate are very good plasticizers but are inert and actually lower the energy content of the nitropolymer. On the other hand, compounds such as diethyleneglycoldinitrate, 1,1,1-trimethylolethanetrinitrate, nitroisobutyltrinitrate, and nitroglycerin contribute energy but they have the undesirable characteristics associated with nitrate esters; toxicity (headache potential), volatility, low thermal stability and high shock sensitivity. Nitroglycerin shows these undesirable properties to the greatest extent.

Nitramine compounds are both energetic and show considerable improvement in hazardous properties over those of the nitrate ester type. The cyclic nitramines, HMX and RDX are routinely used in propellant and explosives today to meet performance and safety goals. However, these nitramines are high melting solids and certainly cannot be used as plasticizers. Some linear nitramines have low melting points which make them potential plasticizers.

SUMMARY OF THE INVENTION

N,N' Dimethyl methylenedinitramine (DMMD) can be considered the simplest member of two series of linear nitramines, with the following elemental structures:

A. $CH_3-\overset{NO_2}{\overset{|}{N}}-(CH_2-\overset{NO_2}{\overset{|}{N}})_n-CH_3$ B. $CH_3-\overset{NO_2}{\overset{|}{N}}-(CH_2)_n-\overset{NO_2}{\overset{|}{N}}-CH_3$ Where (Series A):

n=1, M.P.=55° C., DMMD n=2, M.P.=168°-169° C., 2,4,6-trinitro-2,4,6-triazaheptane n=3, M.P.=213°-218° C., 2,4,6,8tetra nitro 2,4,6,8-tetrazanonane n=5, M.P.=280°-290° C., (Decomposition)

And Where (Series B):

$$n = 1,\ CH_3-\overset{NO_2}{\overset{|}{N}}-CH_2-\overset{NO_2}{\overset{|}{N}}-CH_3 = \text{DMMD}$$

$$n = 2,\ CH_3-\overset{NO_2}{\overset{|}{N}}-CH_2CH_2-\overset{NO_2}{\overset{|}{N}}-CH_3,\ \text{M.P.} = 138°\ \text{C.},$$

N—N'dimethylethylenedinitramine (DMED)

In both series A and B, the simplest member is the same compound, DMMD. It is the only one of these linear nitramines which plasticizes nitrocellulose. N,N' Dimethyl methylene dinitramine is a novel plasticizer for nitrocellulose and the mixture is a novel composition.

A possible explanation for this plasticization ability is given below: The methylene group is probably activated by the two electron-attracting substituents and forms a hydrogen bond with either the hydroxyl or the nitroxy ester groups on the nitrocellulose. These two adjacent nitramine groups do not make the hydrogens in the methylene group (—$CH_2$—) acidic but only polarize them.

Accordingly it is one object of this invention to provide a novel plasticizer for nitrocellulose.

It is also one important object of the invention to provide a novel composition of matter comprising nitrocellulose and N,N' dimethylmethylenedinitramine.

It is another important object of the invention to provide a novel composition of matter comprising nitrocellulose and dimethylmethylenedinitramine and an energetic co-plasticizer from the group comprising bis(2,2-dinitropropyl) formal, Bis(2-fluoro-2,2-dinitroethyl) amine, Bis(2,2,2-trinitroethyl) formal, bis(2-fluoro-2,2-dinitroethyl) formal.

It is a further object of the invention to provide a novel composition of matter comprising nitrocellulose and dimethylmethylenedinitramine and an energetic co-plasticizer and a high-melting nitramine from the group comprising HMX and RDX.

DETAILED DESCRIPTION OF THE INVENTION

The plasticizer N,N' dimethyl methylenedinitramine (DMMD) may be mixed with nitrocellulose and other energetic compounds such as bis(2,2dinitropropyl) formal and Bis(2-fluoro-2,2-dinitroethyl) amine.

The ratio of the mixture of these two compounds to DMMD will usually fall within the ratio from about 1 to 10 to 10 to 1 weight. However, the preferred range is from about 40% to 90% DMMD with the other two plasticizers constituting the balance of the plasticizer mix.

DMMD has good plasticizing ability and at the same time is sufficiently energetic so it will not degrade the performance of the nitropolymer. Although there are plasticizers which exhibit somewhat better plasticizing ability, these compounds all result in lower energy formulations. Likewise, there are plasticizers which have energy equal to or greater than the DMMD, but they are all inferior to this substance in either thermal or safety characteristics.

CHARACTERISTICS OF DMMD

Thermal

DTA (1° C./min)—start of exotherm 178° C.

DSC (20° C.min)—start of exotherm 218° C.

Safety

Impact sensitivity: 3 consecutive positives=300 kg-cm*

Electrostatic sensitivity: 20 consecutive negatives, 5000 volts=8.8 joules

Sliding friction sensitivity: 20 consecutive negatives, 8 ft/sec=740 lbs *Maximum reading on machine at lowest sensitivity. In addition, DMMD will combine with high melting nitrocompounds to lower the freezing point of the mixture to an acceptable value. For example, bis(2,2,2-trinitroethyl) formal has a melting point of 65° C., but a mixture of 40% DMMD and this trinitro-compound melts at 0° C., a lowering of 65° C.

The DMMD can be used to plasticize other polymers. 20% of this compound appears to improve mechanical properties when incorporated into polycaprolactone, carboxyl-terminated polybutadiene or vinyl-terminated polybutadiene binders.

EXAMPLE I

DMMD was mixed with plastisol nitrocellulose (PNC) and the mixture heated to 80° C. A tough polymer was found which remained transparent even after several months at room temperature.

| | |
|---|---|
| 1.0 g | DMMD |
| 1.0 g | PNC |

By comparing the Differential Scanning Calorimeter plots it could be seen that the DMMD dissolved in the nitrocelluose (no melting observed).

EXAMPLE II

DMMD was mixed with a nitrocelluose (13%N) lacquer, the solution poured over a pool of mercury, and then allowed to air dry for four days. A transparent, strong film was formed.

| | |
|---|---|
| 2.0 g | DMMD |
| 2.0 g | nitrocellulose (13% nitrogen) |
| 25 ml | ethyl acetate - solvent mixture |
| 14 ml | ethyl alcohol |

EXAMPLE III

DMMD as coplasticizer; Possible use as a gun propellant.

| | |
|---|---|
| Bis(2,2,2-trinitroethyl)formal | 4.65 g |
| DMMD | 1.49 g |
| Plastisol nitrocellulose | 2.77 g |
| Triacetin | 0.79 |
| Adiponitrile | 0.20 g |
| 2-Nitrodiphenylamine | 0.10 g |

A transparent propellant formed after 3 hours at 65° C. Theoretical: Impetus=$3.85\times10^5$ foot-lb/lb at 3250° K. Nitrogen Taliani at 110° C.=0.36 mm/min.

EXAMPLE IV

DMMD as plasticizer—Gun Propellant

| | |
|---|---|
| Bis(2,2,2-trinitroethyl)formal | 4.65 g |
| DMMD | 2.48 g |

-continued

| | |
|---|---|
| Plastisol nitrocellulose | 2.77 g |
| 2-Nitrodiphenylamine | .10 g |

Formed strong, transparent matrix after heating for 3 hrs at 65° C. Theoretical: Impetus=$4.28\times10^5$ ft-lb/lb at 3816° K.

EXAMPLE V

DMMD as coplasticizer Rocket Propellant

| | |
|---|---|
| Bis(2-fluoro 2,2-dinitroethyl)amine | 5.5 g |
| DMMD | 1.4 g |
| Plastisol nitrocellulose | 2.9 g |
| Adiponitrile | 0.1 g |
| 2-Nitrodiphenylamine | 0.1 g |

Heated in 60° C. oven to form tough, transparent matrix. Nitrogen taliani at 110° C.—Slope is 0.27 mm/min.

Safety Characteristics:

Impact sensitivity: 3 consecutive positives, 5 kg wt. (KG/CM)=125

Friction sensitivity: 20 consecutive negatives, 8 ft/sec (lbs)-980

Electrostatic sensitivity: 20 consecutive negatives, 5000 (joules)-12.5.

EXAMPLE 6

DMMD as coplasticizer, propellant filled with cyclotrimethylenetrinitramine (RDX).

| | |
|---|---|
| Bis(2-fluoro-2,2-dinitroethy)amine | 3.00 g |
| DMMD | 0.84 g |
| Plastisol nitrocellulose | 1.74 g |
| Adiponitrile | 0.06 g |
| 2-Nitrodiphenylamine | 0.06 g |
| Cyclotrimethylenetrinitramine (RDX) | 4.00 g |
| Bis(2-flouro-2,2-dinitroethyl)formal | 0.30 g |

Theoretical: Specific impulse 251 lb sec/lb mass, density 1.689 g/cc.

Many obvious modifications and embodiments of the specific invention, other than those set forth above, will readily come to mind to one skilled in the art and having the benefit of the teachings presented in the foregoing description and the accompanying drawings of the subject invention and hence it is to be understood that such modifications are included within the scope of the appended claims.

What is claimed is:

1. A composition of matter comprising a mixture of nitrocellulose and N,N'dimethyl-N,N' dinitromethanediamine as a plasticizer therefore.

2. The composition of claim 1 where the nitrocellulose has a molecular weight in the range of 10,000 to 50,000 and nitrogen content 11% to 13%.

3. The composition of claim 2 wherein the nitrocellulose is present in an amount of 50% to 95% by weight and the N,N'-dimethyl-N,N'-dinitro methanediamine is present in an amount of 5% to 50% by weight.

4. A composition of matter comprising a mixture of nitrocellulose and N,N'-dimethyl-N,N'-dinitromethanediamine as a plasticizer thereof, and further comprising an energetic coplasticizer selected from the group consisting of bis(2,2 dinitropropyl) formal, bis(2,2,2-trinitroethyl) formal, bis(2-fluoro-2,2-dinitroethyl)amine, and bis(2,2-fluoro-2,2-dinitroethyl) formal.

5. The composition of claim 4 wherein the ratio of N,N' dimethyl-N,N' dinitro-methanediamine dinitramine to energetic co-plasticizer varies from about 10 to 1 to about 1 to 10.

6. The composition of claim 4 wherein the composition is filled with a high melting nitramine from the group comprising HMX (cyclotetramethylenetetranitramine) and RDX (cyclotrimethylenetrinitramine).

7. A novel composition of matter comprising a mixture of nitrocellulose, N,N'-dimethyl-N,N'-dinitro methanediamine as a plasticizer and a filler selected from the group consisting of RDX and HMX.

8. A rocket propellant comprising a mixture of nitrocellulose, N,N'-dimethyl-N,N' dinitro-methanediamine as a plasticizer and a filler comprising a cyclic nitramine.

* * * * *